US008668002B2

(12) United States Patent
Chen

(10) Patent No.: US 8,668,002 B2
(45) Date of Patent: Mar. 11, 2014

(54) ROLLER WINDING ROMAN STYLE SHADE

(75) Inventor: Lin Chen, Dongguan (CN)

(73) Assignee: Nien Made Enterprise Co., Ltd., Taichung (TW)

( * ) Notice: Subject to any disclaimer, the term of this patent is extended or adjusted under 35 U.S.C. 154(b) by 425 days.

(21) Appl. No.: 13/006,929

(22) Filed: Jan. 14, 2011

(65) Prior Publication Data

US 2012/0043027 A1 Feb. 23, 2012

(30) Foreign Application Priority Data

Aug. 23, 2010 (CN) ..... 2010 2 0503054 U

(51) Int. Cl.
*E06B 9/40* (2006.01)

(52) U.S. Cl.
USPC ..... 160/89; 160/84.04; 160/108

(58) Field of Classification Search
USPC ..... 160/84.04, 84.01, 108, 89, 84.05, 160/84.06, 121.1, 85, 86
See application file for complete search history.

(56) References Cited

U.S. PATENT DOCUMENTS

| | | | | | |
|---|---|---|---|---|---|
| 1,789,724 | A * | 1/1931 | Carver | 160/84.01 |
| 2,110,983 | A * | 3/1938 | Carver | 160/84.04 |
| 2,260,101 | A * | 10/1941 | De Falco | 160/84.04 |
| 3,817,309 | A * | 6/1974 | Takazawa | 160/84.01 |
| 4,397,347 | A * | 8/1983 | Brabant | 160/231.2 |
| 4,934,435 | A * | 6/1990 | Regev | 160/84.04 |
| 5,205,334 | A * | 4/1993 | Judkins | 160/89 |
| 5,690,156 | A * | 11/1997 | Ruggles | 160/84.04 |
| 6,116,319 | A * | 9/2000 | Simon | 160/84.01 |
| 6,152,207 | A * | 11/2000 | Varley | 160/264 |
| 7,975,747 | B2 * | 7/2011 | Liang et al. | 160/84.04 |
| 8,066,050 | B2 * | 11/2011 | Lin | 160/84.04 |
| 8,113,261 | B2 * | 2/2012 | Lin | 160/84.01 |
| 8,127,821 | B2 * | 3/2012 | Hsu et al. | 160/84.01 |
| 8,186,411 | B2 * | 5/2012 | Lin | 160/84.01 |
| 8,186,412 | B2 * | 5/2012 | Lin | 160/84.01 |
| 8,281,842 | B2 * | 10/2012 | Lin | 160/84.04 |
| 8,291,959 | B2 * | 10/2012 | Cheng | 160/84.01 |
| 2010/0269985 | A1 * | 10/2010 | Hanley et al. | 160/84.04 |
| 2010/0294438 | A1 * | 11/2010 | Kirby et al. | 160/84.04 |
| 2011/0067820 | A1 * | 3/2011 | Hsu et al. | 160/84.03 |
| 2011/0146918 | A1 * | 6/2011 | Vestal | 160/84.06 |
| 2011/0162806 | A1 * | 7/2011 | Lin | 160/84.04 |
| 2011/0192550 | A1 * | 8/2011 | Williams, III | 160/84.04 |
| 2011/0247761 | A1 * | 10/2011 | Lin | 160/84.02 |

(Continued)

FOREIGN PATENT DOCUMENTS

CN 201433692 Y 3/2010

*Primary Examiner* — David Purol
(74) *Attorney, Agent, or Firm* — WPAT, PC; Justin King

(57) ABSTRACT

A roller-shade winding roman style shade is provided. A technical feature thereof is to utilize an actuating member of a cord or a band-shaped long strip of fabric to connect a blind material and a roller shade. Thus, as the roller shade rises, the parts where the blind material and the actuating member are connected are pulled up sequentially from the bottom up, and when reaching the top end, the points where the blind material and the actuating member are connected are kept at approximately the same height, such that the roman style shade is in a retracted and folded state. The blind material of the whole roman style shade can be folded up or dropped down merely through connection of the actuating member between the blind material and the roller shade, the roller shade has diversified applications and is more flexible in use and pleasant to look at.

17 Claims, 9 Drawing Sheets

(56) References Cited

U.S. PATENT DOCUMENTS

2011/0247762 A1* 10/2011 Lin ..... 160/84.02
2011/0247765 A1* 10/2011 Lin ..... 160/133
2011/0253324 A1* 10/2011 Lin ..... 160/309
2012/0043027 A1* 2/2012 Chen ..... 160/84.04
2012/0067527 A1* 3/2012 Cheng ..... 160/84.02
2012/0097342 A1* 4/2012 Tu ..... 160/84.04
2012/0103538 A1* 5/2012 Gleinser ..... 160/84.04
2013/0020034 A1* 1/2013 Perkowitz ..... 160/84.04

* cited by examiner

ROLLER WINDING ROMAN STYLE SHADE

CROSS-REFERENCE TO RELATED APPLICATION

This application claims the benefit of China Patent Application No. 201020503054.7, filed on Aug. 23, 2010, which is hereby incorporated by reference for all purposes as if fully set forth herein.

BACKGROUND OF THE INVENTION

1. Field of Invention

The present invention relates to a roller winding roman style shade, and more particularly to a technology that a roman style shade can be controlled by a roller shade to achieve a rise-up or drop-down action with a simple structure and low production cost.

2. Related Art

A roman style shade is also referred to as a "vertical folding shade". As the name suggests, the roman style shade can be folded layer by layer, to achieve a stronger stereoscopic appeal and luxurious feeling than a full-face roller shade. Moreover, a variety of material or fabric can be chosen for roman style shade and roller shade, which facilitates the matching with the color systems and textures of interior decorations such as the bedding, mounted fabric, and sofa.

The roman style shade can be categorized into a blind/shade structure that needs to use a cord to manually control the winding and unfolding actions thereof and a cordless roman style shade that realizes winding and unfolding with an automatic winding wire grip (including an electric-control elevation mode).

Chinese Patent No. CN201433692Y titled "BLIND USING ROLLER SHADE FOR WINDING ROMAN STYLE SHADE" discloses a blind/shade structure of a double-blanket roman style shade. A technical feature thereof is to dispose more than one limit device at a rear side of a fabric screen, a fixing device located below the last limit device, and an auxiliary beam disposed at an end of the fabric screen. The roller shade includes a shaft rod disposed below a major beam and a screen. An end of the screen is disposed inside the shaft rod, and the other end penetrates the multiple limit devices at the rear side of the roman style shade and is fixed on the fixing device. The limit device generally has more than one limit rod fixed at the rear side of the fabric screen at intervals, two double-snap rings, and an auxiliary rod. The limit rod is opened with a groove, and the fabric screen is fitted in the groove and retained thereby. Two end portions of the limit rod are respectively installed with one double-snap ring. Each double-snap ring is opened with a first groove and a second groove, the first grooves are respectively clamped at the two end portions of the limit rod, and the auxiliary rod is used for positioning by penetrating the second grooves of the two double-snap rings, so that an extending space for the roller shade to pass through is formed between the auxiliary rod and the limit rod.

However, although the technical structure as described above makes it easy for a user to wind or unfold the roman style shade, the technical structure is complicated and many limit devices are needed for positioning, so that not only the overall weight of the roman style shade is increased, but also the fabrication cost is greatly increased, and meanwhile, more elements are adopted, which indicates that the technical product is not environmentally friendly.

SUMMARY OF THE INVENTION

Therefore, in order to solve the disadvantages above, an objective of the present invention is to provide a new type of roller—winding roman style shade, which uses at least one cord, tape or band to connect a front-side roman style shade-and a rear-side roller shade together, and as the roller shade rises, the parts where the front-side roman style shade is connected to the cord (or tape or band) are pulled up sequentially from the bottom up, thus achieving a simple structure and a low fabrication cost and also satisfying the purpose of environmental protection.

To achieve the above objectives, the present invention provides a roller winding roman style shade. The roman style shade includes: a blind material serving as a front side of the roman style shade, in which the blind material is capable of being folded up layer by layer and unfolded by drop-down; and a roller shade serving as a rear side of the roman style shade, in which an upper end of the roller shade is installed and fixed on a shaft rod and correspondingly connected to the blind material. At least an actuating member is disposed between the blind material and the roller shade, and as the roller shade rises, the parts where the blind material and the actuating members are connected are pulled up sequentially from the bottom up through the actuating members, such that the blind material is in a retracted and folded state.

The actuating member can be a cord, tape, band or a long strip of fabric, and may also be other devices capable of actuating the blind material in actual implementation, as long as the wound state of the roller shade is not affected. In practice, the plurality of actuating members on the same vertical line may be connected to the roller shade at the same position, or connected to the roller shade at equal intervals, or connected to the roller shade with intervals gradually increasing from the bottom up.

The roller shade may instead be formed of multiple rolling strips of fabric, and each of the rolling strips of fabric is disposed with the actuating members connected to support rods of the blind material, so as to add design applications of the roller shade with the peripheral space.

An advantage of the present invention is that the roman style sande of the present invention utilises the actuating members of the cord or the band-shaped long strip of fabric to connect the blind material and the roller shade, so that as the roller shade rises, the lowermost support rod is firstly pulled up with the roller shade, then in sequence the lowermost actuating member is pulled tight to actuate the intermediate support rod to move upward, and fmally the uppermost actuating member is pulled tight to cause the uppermost support rod to move upward, until the roller shade is pulled to the top, and a folded retraction effect is realized. The roller shade of the whole roman style shade can be folded up or dropped down merely through connection of the actuating members between the blind material and the roller shade, so that the roman style shade has a simple structure and lower element cost than commercially available double-shade roman style shade, and moreover, since the fewest elements are used, the roller shade has diversified applications and is more flexible in use and pleasant to look at, and environmental protection objectives in production and use are also satisfied.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The detailed illustration and technical contents of the present invention are described below with reference to the accompanying drawings.

Figure 1:
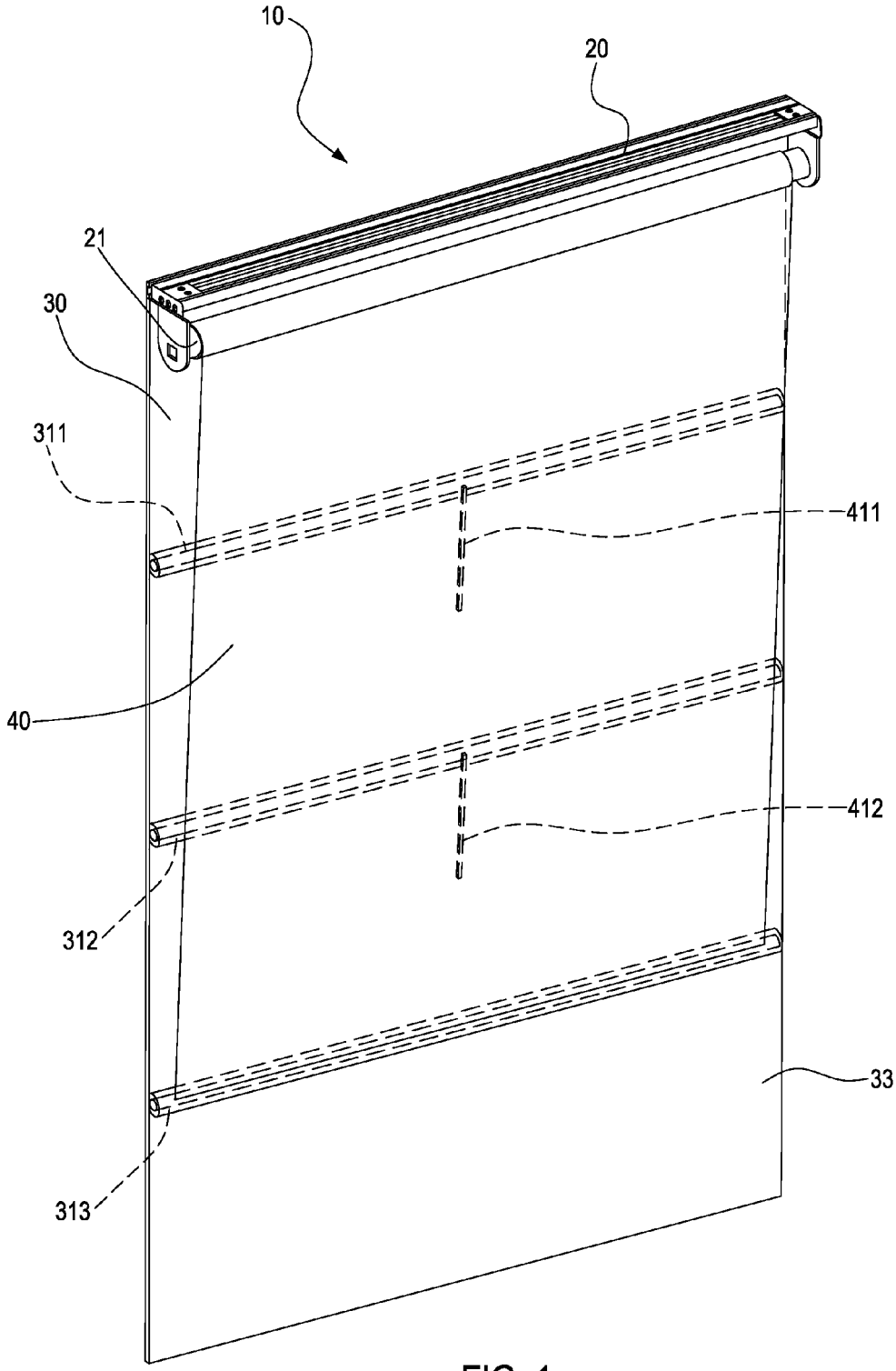
FIG. 1 is a schematic three-dimensional view according to an embodiment of the present invention.
Figure 2:
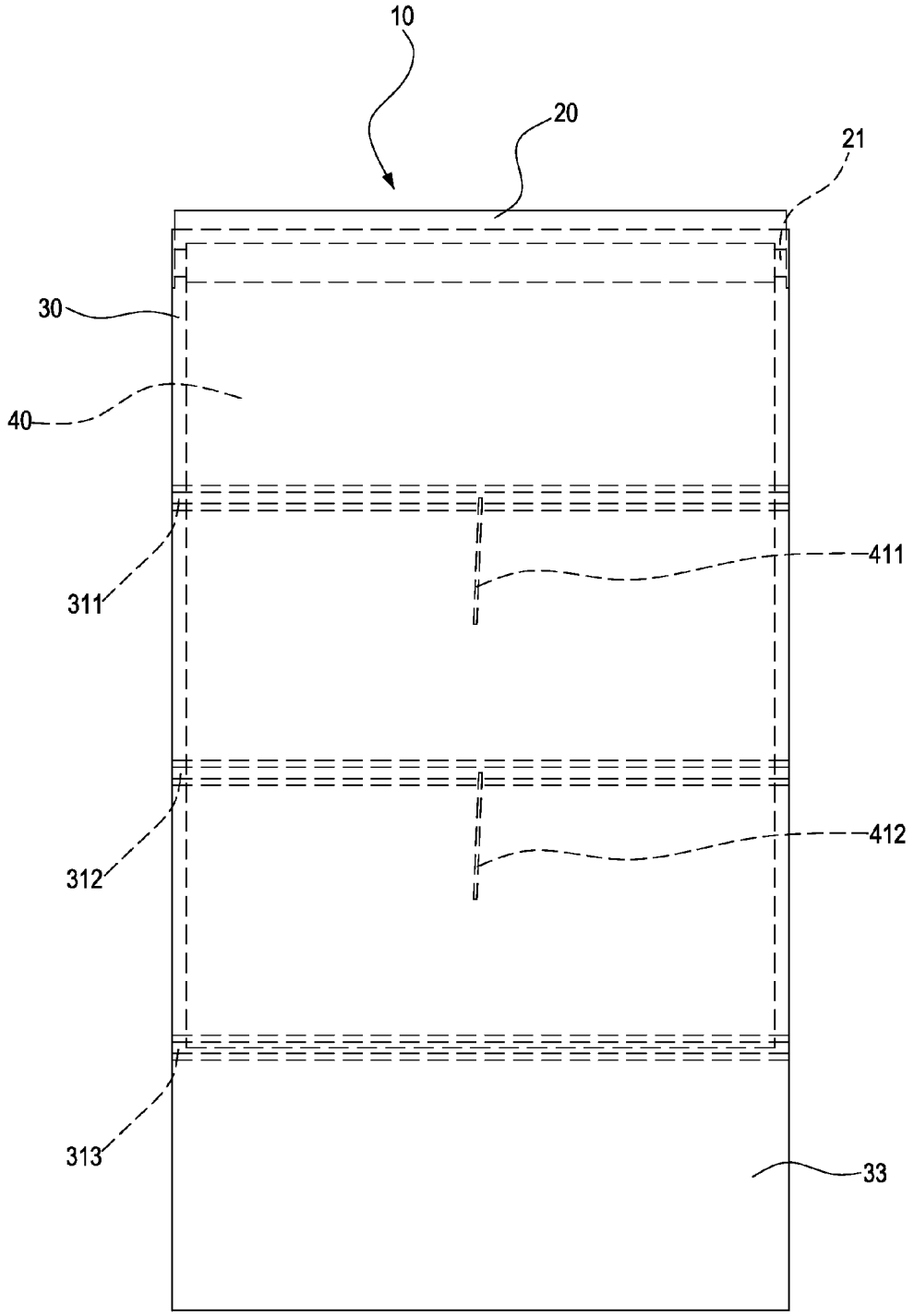
FIG. 2 is a schematic front view according to an embodiment of the present invention.

FIGS. 1 and 2 are respectively a schematic three-dimensional view and a schematic front view according to an embodiment of the present invention. A roman style shade 10 of the present invention utilises a roller shade to wind a blind material. In actual implementation, the roman style shade 10 is installed on a wall at an inner side of a top edge of a window, and includes a blind material 30 serving as a front side of the roman style shade 10, and a roller shade 40 serving as a rear side of the roman style shade 10. Usually, a beam frame 20 is laterally disposed on the wall. One end of the blind material 30 is fixed at a side of the beam frame 20, and a plurality of support rods 311, 312, and 313 (three support rods are provided in this embodiment for illustration, but not limited thereto) is disposed at the rear side of the blind material 30 to support the unfolding of the blind material 30, and enable the blind material 30 to be folded up or dropped down while staying close to the window. One end of the roller shade 40 is installed and fixed on a shaft rod 21 inside the beam frame 20, and the other end is joined to the lowermost support rod 313 of the blind material 30. In practice, in addition to the lowermost support rod 313 of the blind material 30, the rest of the support rods 311 and 312 of the blind material 30 are respectively disposed with at least one actuating member 411 and actuating member 412 connected to the roller shade 40 in a horizontal plane thereof. That is, one end of the actuating member is connected to the support rod, and the two ends of the actuating member are respectively connected to the corresponding surfaces of the blind material 30 and the roller shade 40 in a horizontal plane thereof; moreover, the length of the actuating member may be longer than a distance between the corresponding surfaces of the blind material 30 and the roller shade 40.

In addition, in one embodiment, the blind material 30 and the roller shade 40 may be made separately; however, in one embodiment, the blind material 30 and the roller shade 40 may be formed by a continuous same piece of material or fabric.

The actuating members 411 and 412 may be a flexible material with an adequate length such as cords, long strips of fabric, or other band-shaped materials that can be connected to the blind material 30 and actuate the same, as long as the wound state of the roller shade is not influenced in actual implementation. The actuating members 411 and 412 may also have one end connected to the blind material 30 through some safely detachable mechanisms, so as to form a safety mechanism of automatic detachment, thus avoiding winding incidents caused by the actuating members 411 and 412. Further, as shown in the figures, an embodiment is given in which one of the actuating members 411 and 412 is disposed in the same horizontal plane, and in other implementations, more than two actuating members may be respectively disposed in the same horizontal plane by taking the width and the overall weight of the blind material 30 into consideration.

Figure 3:
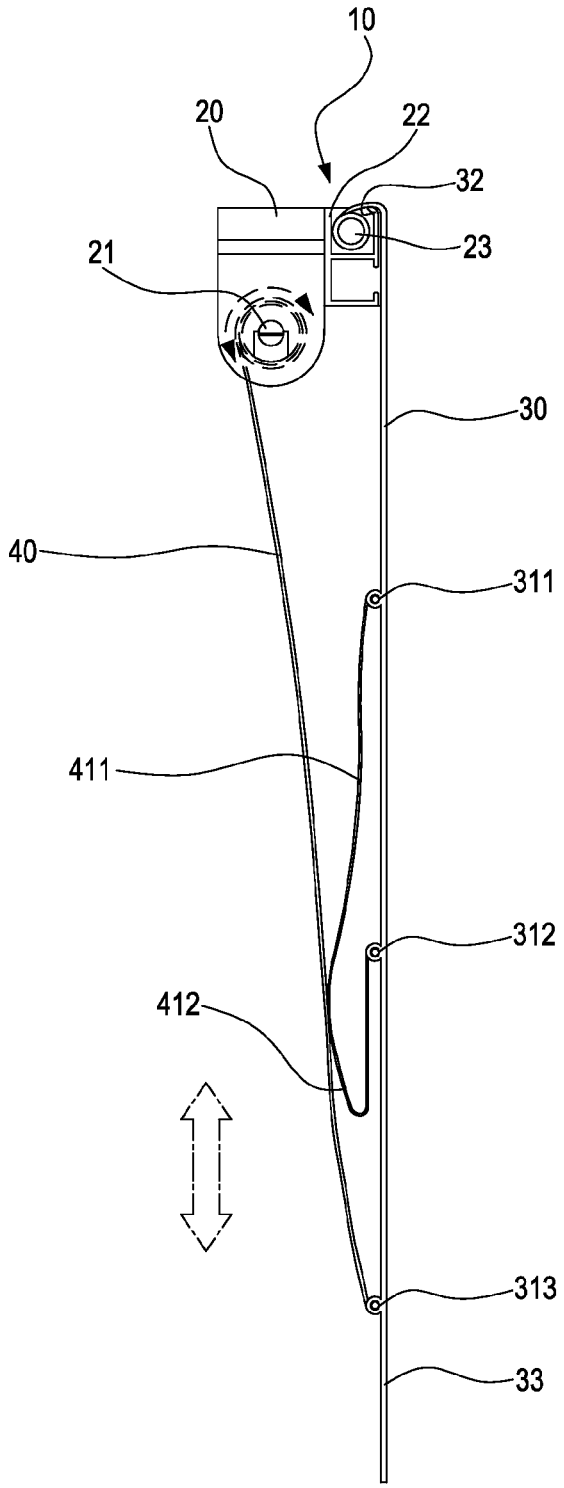
FIG. 3 is a side view according to an embodiment of the present invention.
Figure 4:
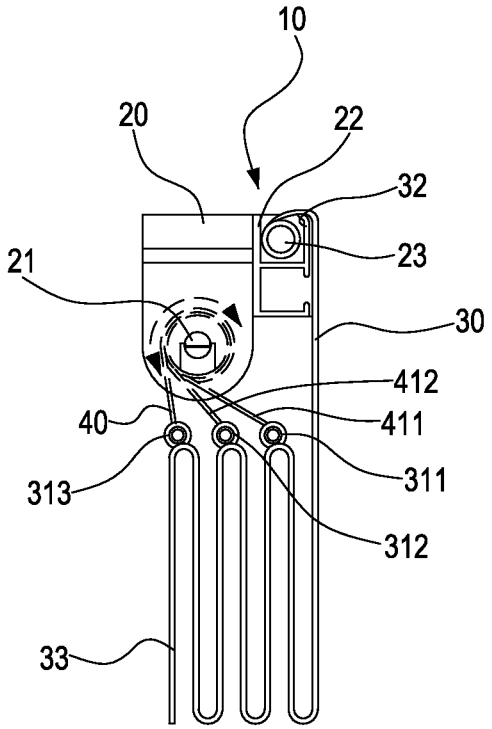
FIG. 4 is a side view of a wound state according to an embodiment of the present invention.

Referring to FIGS. 3 and 4, the beam frame 20 may be made of wood or formed through aluminum extrusion, and is disposed and fixed on the wall in a horizontal direction. A long groove rail 22 is provided at a side of the beam frame 20. A fixation segment 32 at an end of the blind material 30 can be fixed inside the long groove rail 22 through a fixing device 23, thereby fixing a corresponding relation between the beam frame 20 and the blind material 30.

Figure 6:
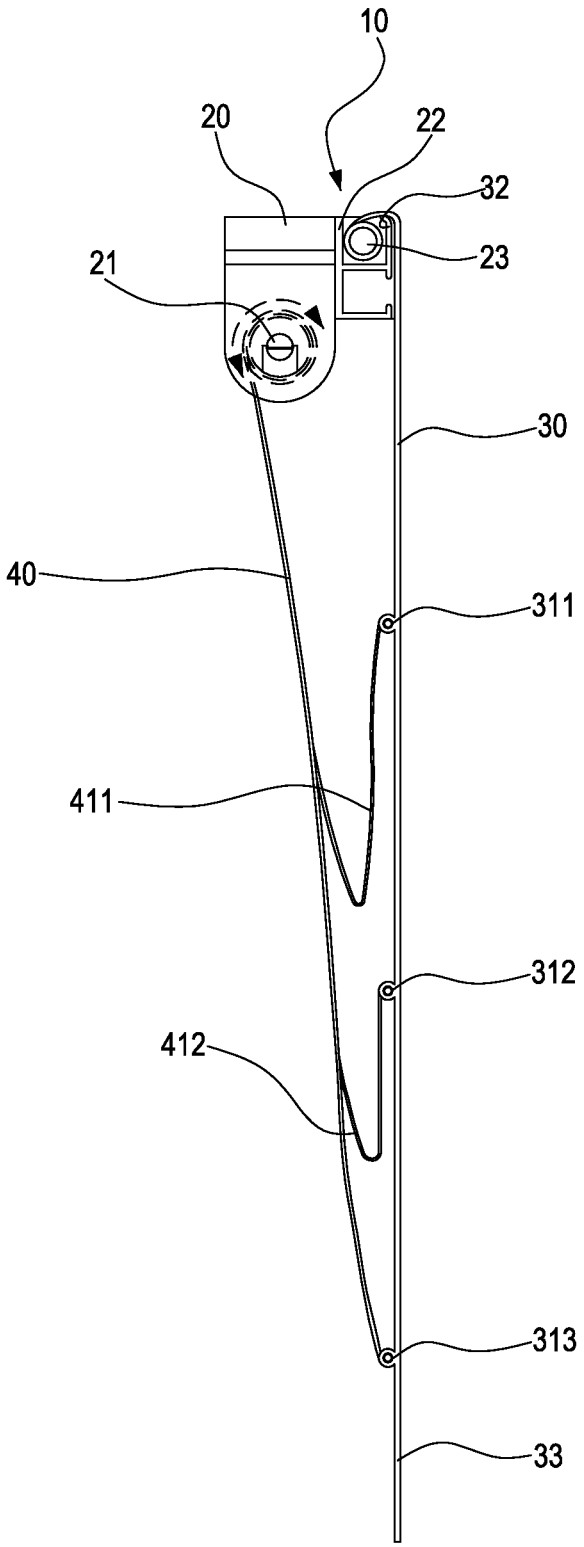
FIG. 6 is a schematic view of a cord according to another embodiment of the present invention.

The actuating members 411 and 412 at the same vertical line may be connected to the roller shade 40 at the same position (as shown in FIG. 3), or connected to the roller shade 40 at equal intervals (as shown in FIG. 6). In addition, the actuating members 411 and 412 may also have unequal intervals, for example, the intervals increase in sequence from top to bottom, so as to form a step-like folding which is pleasant to look at.

Figure 5:
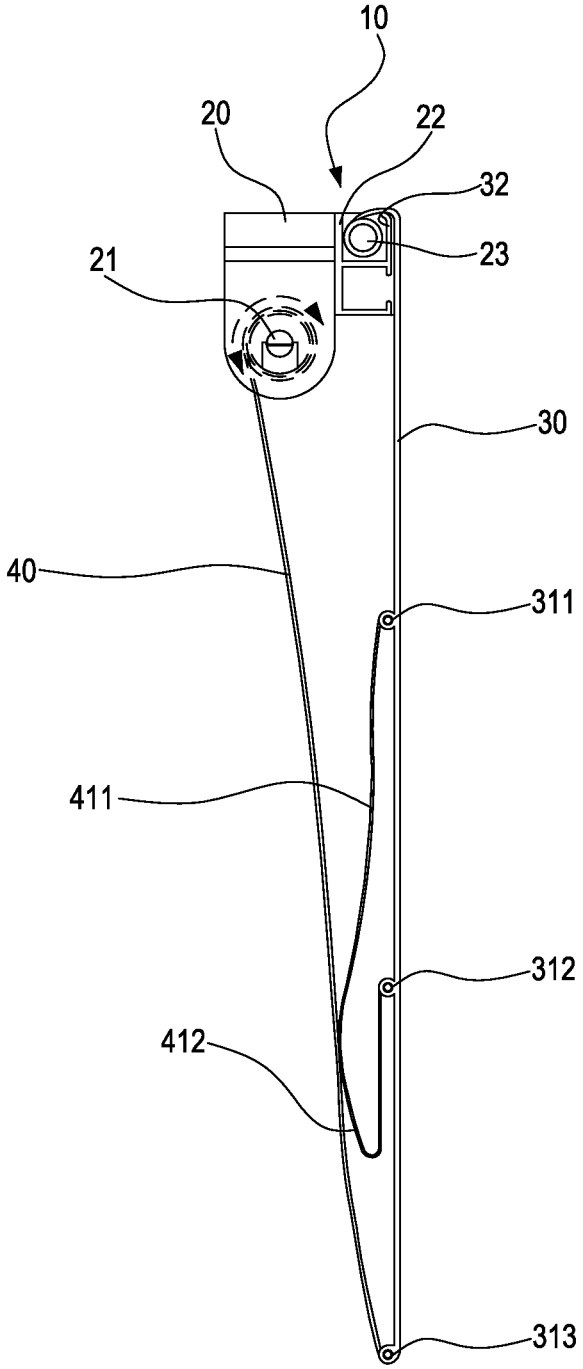
FIG. 5 is a schematic view of a roman style shade according to another embodiment of the present invention.

In the implementation of the roman style shade 10, a tail blind material 33 can be disposed below the lowermost support rod 313 of the blind material 30, and it can be selected whether to dispose a balance weight lever (not shown) below the tail blind material 33, the major function of which is to form a drop-down state at the end of the blind material 30. Alternatively, the blind material 30 has a form without the tail blind material 33 (as shown in FIG. 5), and instead the end of the roller shade 40 is directly disposed at the end of the blind material 30. Through such joint mode, the blind material 30 and the roller shade 40 may be formed by the same piece of material or respective by two pieces of material, and a total drop-down length of the blind material 30 depends on the height of the window opening, which is generally greater than or equal to the height of the window opening.

Moreover, an automatic winding device (not shown) is provided inside the shaft rod 21 within the beam frame 20, so as to actuate the shaft rod 21 to wind and unfold the blind material 30. In the implementation, when the roman style shade 10 is in a fully-shaded state, the blind material 30 and the roller shade 40 are dropped down completely, and in operation, the blind material 30 and the roller shade 40 are connected through the actuating members 411 and 412, so the blind material 30 rises as the roller shade 40 is actuated by the shaft rod 21 (as shown in FIG. 3). Firstly, the lowermost support rod 313 is pulled up with the roller shade 40, and then in sequence the lowermost actuating member 412 is pulled tight to actuate the intermediate support rod 312 to move upward, and finally the uppermost actuating member 411 is pulled tight to actuate the uppermost support rod 311 to move upward. When the blind material 30 is pulled to the top end, the three support rods 311, 312, and 313 of the blind material 30 are kept at approximately the same height, so that the whole blind material 30 is in a retracted and folded state (as shown in FIG. 4), thus realizing a folded retraction effect.

In practice, when the user intends to wind the blind material 30 of the roman style shade 10, the user can directly hold the lowermost support rod 313 of the blind material 30 with the hand and apply a force upward, so that through the automatic winding function of the automatic winding device, and pulled upward through the roller shade 40, the blind material 30 is synchronously pushed upward to a fold-up state (as shown in FIG. 4). In addition, when the user intends to unfold the blind material 30 of the roman style shade 10, likewise, the user holds the lowermost support rod 313 of the blind material 30 with the hand and applies a force downward, and thus the blind material 30 is unfolded under the actions of the automatic winding device together with related means.

Figure 7:
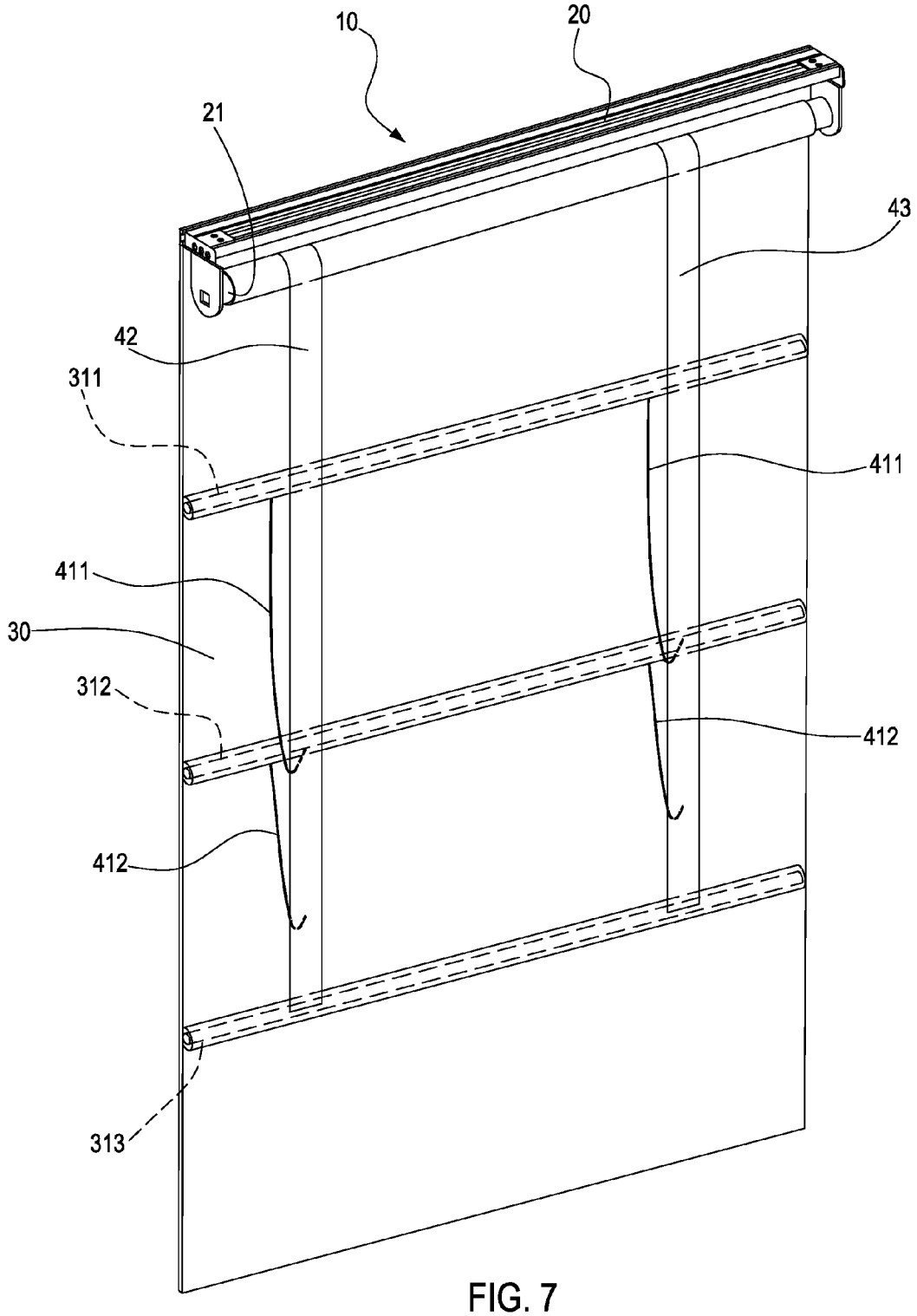
FIG. 7 is a schematic view of a roller shade according to another embodiment of the present invention.

Furthermore, in the implementation, the roller shade 40 may be formed of more than two rolling strips of fabric 42 and 43 (as shown in FIG. 7). The rolling strips of fabric 42 and 43 are respectively disposed with the actuating members 411 and 412 connected to the support rods 311 and 312 of the blind material 30, thus increasing matching applications of the roller shade 40 with the peripheral space based on different interior decoration designs. Similarly, the actuating members 411 and 412 at the same vertical line are connected to the rolling strip of fabric 42 or 43 at the same position, or connected to the rolling strip of fabric 42 or 43 at equal intervals (as shown in FIG. 7). In addition, the actuating members 411 and 412 may also have unequal intervals, for example, the intervals increase in sequence from top to bottom, thus forming a step-like folding which is pleasant to look at.

Figure 8:
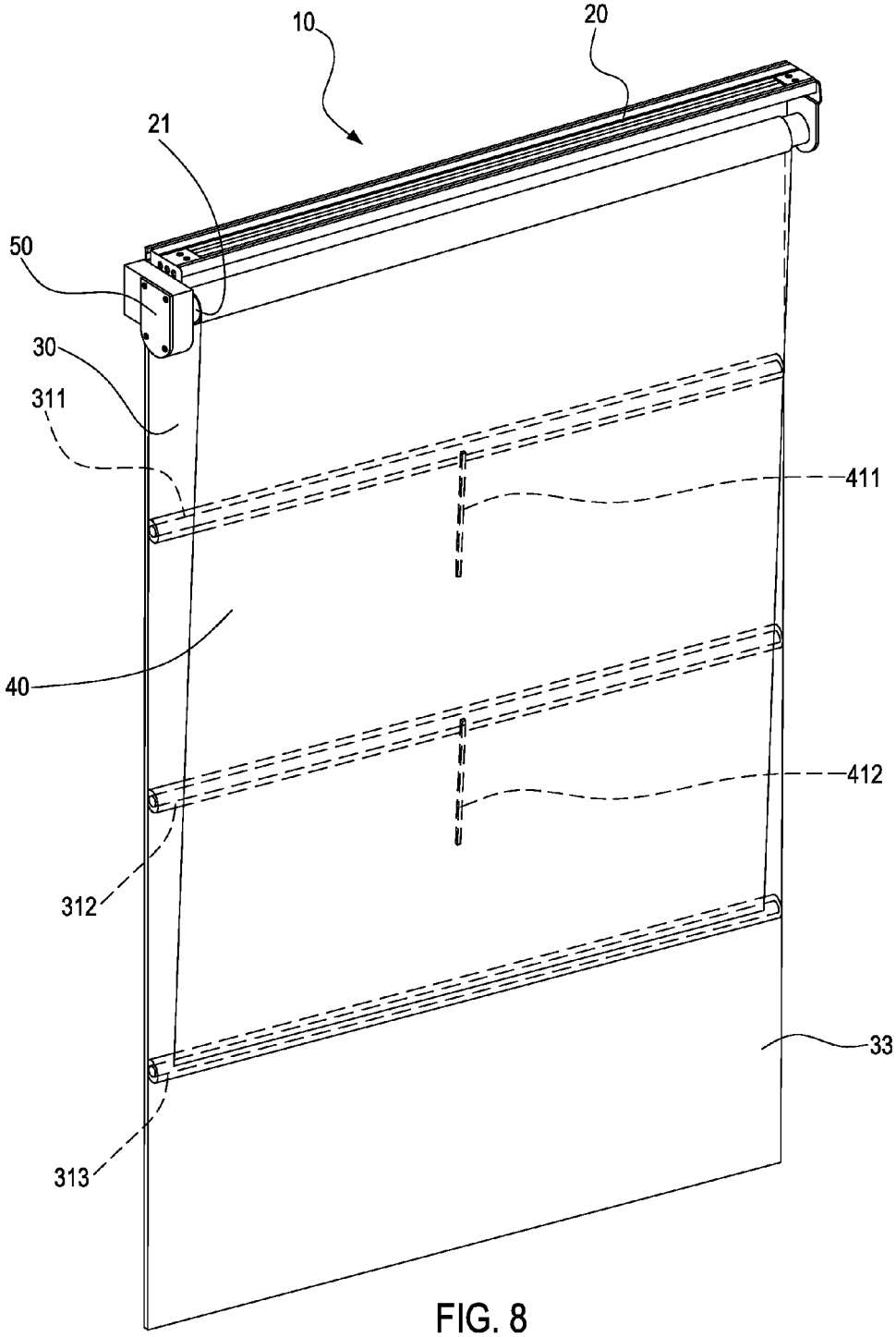
FIG. 8 is a schematic three-dimensional view of electric-winding according to the present invention.
Figure 9:
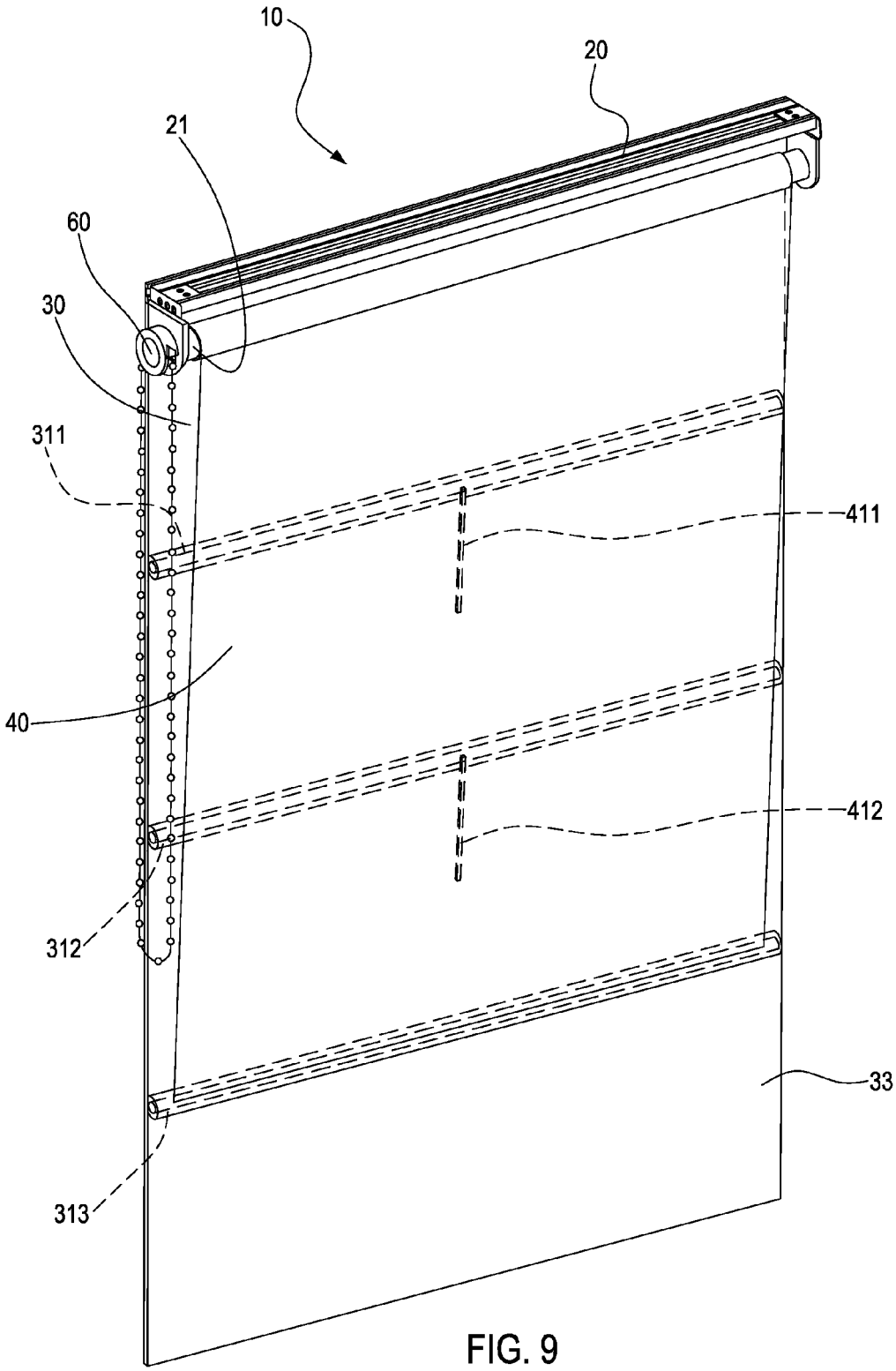
FIG. 9 is a schematic three-dimensional view of manual bead-chain winding according to the present invention.

In addition, to accommodate for different user habits, in the implementation of the present invention, an electric winding device 50 may be disposed at a side of the shaft rod 21, as shown in FIG. 8, and thus another roman style shade 10 that the roller shade 40 can be electrically operated to wind the blind material 30 is provided, for example, through remote operation. Alternatively, as shown in FIG. 9, a manual bead-chain device 60 is disposed at a side of the shaft rod 21, so as to form a roman style shade 10 that the roller shade 40 can be manually operated to wind the blind material 30.

Although the present invention is already disclosed above with reference to preferred embodiments, it should be understood by persons skilled in the art that the embodiments are merely used to describe the present invention, and should not be construed as limits to the scope of the present invention. It should be noted that the changes and replacements equivalent to the embodiments shall fall within the scope of the present invention. Therefore, the protection scope of the present invention should be as defined by the following claims.

What is claimed is:

1. A roller-shade winding roman style shade, comprising:

a blind material, serving as a front side of the roman style shade a roller shade, serving as a rear side of the roman style shade, and an upper end thereof being installed and fixed on a shaft rod and being correspondingly connected to the blind material, wherein at least an actuating member is disposed between the blind material and the roller shade, a portion of the at least one actuating member is connected to the roller shade so as to fold the blind material from the bottom up by retracting the roller shade, and when the roller shade is wound around the shaft rod, the at least one actuating member is wound around the shaft rod.

2. The roman style shade according to claim 1, wherein the actuating member is a cord.

3. The roman style shade according to claim 1, wherein the actuating member is a strip of fabric.

4. The roman style shade according to claim 1, wherein a plurality of actuating members is disposed between the blind material and the roller shade.

5. The roman style shade according to claim 4, wherein the plurality of actuating members and the roller shade are connected to each other.

6. The roman style shade according to claim 4, wherein connection points between the plurality of actuating members and the blind material have equal intervals, the intervals are along the blind material.

7. The roman style shade according to claim 4, wherein connection points between the plurality of actuating members and the blind material have intervals gradually increasing from the bottom up.

8. The roman style shade according to claim 1, wherein the roller shade is formed of more than two rolling strips of fabric.

9. The roman style shade according to claim 8, wherein the rolling strips of fabric are respectively disposed with the actuating members connected to the blind material.

10. The roman style shade according to claim 8, wherein the plurality of actuating members on each rolling strip of fabric are connected at the same position.

11. The roman style shade according to claim 8, wherein connection points between the plurality of actuating members on each rolling strip of fabric have equal intervals.

12. The roman style shade according to claim 8, wherein connection points between the plurality of actuating members on each rolling strip of fabric have intervals gradually increasing from the bottom up.

13. The roman style shade according to claim 1, wherein the blind material and the roller shade is formed by a continuous same piece of material or fabric.

14. The roman style shade according to claim 1, wherein the actuating member is a flexible material.

15. The roman style shade according to claim 1, wherein two ends of the actuating member are respectively connected to the blind material and the roller shade in a horizontal plane thereof.

16. The roman style shade according to claim 1, wherein the blind material is horizontally disposed with at least one support rod, and one end of the actuating member is connected to the support rod.

17. The roman style shade according to claim 1, wherein a length of the actuating member is longer than a distance between the blind material and the roller shade.

* * * * *